United States Patent [19]

Crosby

[11] 4,082,625

[45] Apr. 4, 1978

[54] ELECTRODEPOSITION OF RUTHENIUM

[75] Inventor: Jeffrey Norman Crosby, Kidderminster, England

[73] Assignee: The International Nickel Company, Inc., New York, N.Y.

[21] Appl. No.: 802,437

[22] Filed: Jun. 1, 1977

[30] Foreign Application Priority Data

Jun. 8, 1976 United Kingdom ..... 23653/76

[51] Int. Cl.[2] ..... C25D 3/50

[52] U.S. Cl. ..... 204/47; 423/413; 423/463

[58] Field of Search ..... 204/47, 109, 43 N; 423/351, 413, 463, 22, 512

[56] References Cited

U.S. PATENT DOCUMENTS

| | | | |
|---|---|---|---|
| 2,057,638 | 10/1936 | Zimmermann et al. | 204/47 |
| 2,451,340 | 10/1948 | Jernstedt | 204/43 |
| 3,123,544 | 3/1964 | Blake | 204/47 |
| 3,576,724 | 4/1971 | Reddy et al. | 204/47 |
| 3,630,856 | 12/1971 | Meyer | 204/43 N |
| 3,692,641 | 9/1972 | Losi et al. | 204/43 N |
| 3,793,162 | 2/1974 | Hope | 204/47 |
| 3,892,638 | 7/1975 | Stevens et al. | 204/43 N |
| 3,920,407 | 11/1975 | Mynard et al. | 29/182.3 |

FOREIGN PATENT DOCUMENTS

| | | | |
|---|---|---|---|
| 1,244,309 | 8/1971 | United Kingdom | 204/47 |

*Primary Examiner*—G. L. Kaplan

*Attorney, Agent, or Firm*—Ewan C. MacQueen; George N. Ziegler

[57] ABSTRACT

Articles are electroplated with ruthenium in plating bath containing ruthenium cationic complex $[Ru_2N(NH_3)_8X_2]^{3+}$. Bath provides advantages of enabling plating in alkaline solution, where desired, and avoids difficulties of protecting articles against attack by acid electrolyte baths.

21 Claims, No Drawings

ELECTRODEPOSITION OF RUTHENIUM

This invention relates to the electrodeposition of ruthenium and baths therefor.

Electrodeposits of ruthenium possess excellent electrical conductivity and wear resistance during extensive use and are therefore valuable for use as coatings for electrical contacts, for example those in reed switches or relays. In such switches an electrical circuit is made or broken by controlled expansion alloy wires or reeds which are sealed in a glass capsule in an inert atmosphere. At the areas of contact the wires are flattened and then plated prior to sealing into the capsule. Gold has commonly been employed as the plating material but more recently it has been proposed to use ruthenium as an alternative in view of its greater hardness, comparable electrical and wear-resistance properties and because it is relatively inexpensive.

However, currently available ruthenium electroplating baths suffer from the disadvantage that in general they must be operated under acidic conditions. For example, U.K. Patent Specification No. 1,244,309 refers to electrodeposition of ruthenium from a bath comprising an aqueous solution of the anionic complex $[Ru_2N(H_2O)_2Y_8]^{3-}$ where each Y is either chlorine or bromine. In order to form an acceptable deposit it is essential that the pH of the solution does not exceed 4 and commercially available electrolytes containing this complex commonly have a pH of the order of 1.5.

Many metallic substrates, including various nickel-iron alloys in reed switches, as well as copper, nickel and the like, cannot be satisfactorily plated using these acidic electrolytes without first applying a protective 'flash' coating of gold or other suitable metal to the substrate.

The present invention provides a process in which ruthenium is electrodeposited from a bath comprising an aqueous solution of a ruthenium compound in which the ruthenium is present in a cationic complex of the formula $[Ru_2N(NH_3)_8X_2]^{3+}$ where X is chlorine, bromine or iodine. The baths themselves also form part of the invention.

The anion of the ruthenium compound is advantageously a halide which is the same as that in the cation. A typical compound is therefore $[Ru_2N(NH_3)_8Cl_2]Cl_3$.

It is an advantage of the baths of the invention that they are stable during electrodeposition over all pH values, i.e., including alkaline values. They provide, therefore, a means by which ruthenium may be electrodeposited directly from alkaline electrolytes onto a base metal substrate without the need for a protective coating on the substrate. In fact it is found that the best ruthenium deposits are obtained at pH values of 10 to 14, advantageously at least 12. Adjustments to the pH value of the bath can readily be effected by the addition of an alkali metal hydroxide or ammonium hydroxide. If necessary adjustment to more acidic pH values can be made with any strong acid which is compatible with the electrolyte, for example sulphamic acid or phosphoric acid.

It is a further advantage of the baths, that whereas alkaline solutions tend necessarily to absorb carbon dioxide from the atmosphere, such absorption with the baths of the invention does not in general affect plating performance.

Although successful electroplating can be carried out from the baths without making further additions it is commonly preferable to include a supporting additive which improves the bath conductivity, particularly one that exhibits buffering action. A preferred additive is a phosphoric acid/phosphate mixture which can conveniently be formed by the addition of, for example 5 to $50 gl^{-1}$ of potassium dihydrogen phosphate, $KH_2PO_4$. Such an additive improves the general characteristics of the ruthenium deposit, particularly its brightness and thickness prior to the appearance of any surface cracking. The phosphoric acid/phosphate additive in particular has the additional advantage that it acts as a buffer and prevents large changes of pH during the plating process. Other supporting additives that may be employed in a similar manner include sulphamic acid/sulphamate formed by the addition of, for example, 5 to 50 $gl^{-1}$ of sulphamic acid and acetic acid/acetate formed by the addition of similar amounts of acetic acid. Both the latter additives also act as buffers.

Successful electrodeposition is not critically dependent on the ruthenium concentration of the bath. Conveniently, the concentration is such that 0.5 to 20 $gl^{-1}$ of ruthenium are present. With very low ruthenium concentrations the deposits tend to be poor, and, although higher concentrations can be employed up to the limit of solubility of the complex salt, there is no practical advantage in doing so. Moreover, losses of ruthenium from the bath by 'drag out' increase with increasing concentrations. Preferably the ruthenium concentratiion is less than 10 $gl^{-1}$, for example 5 $gl^{-1}$. Replenishment of the ruthenium content of the bath during plating can be effected simply by addition of the solid ruthenium compound.

Electrodeposition can be effected over a wide range of operating temperatures from room temperature upwards. However, the plating rate increases with increasing temperature and the bath temperature preferably is at least 60° C. Above 80° C evaporation from the bath becomes a problem and periodic replenishment of water may be necessary to retain the original bath concentrations. The most preferred temperature is therefore of the order of 70° C.

A cathode current density of up to 5 $A/dm^2$ can be usefully employed. Above this figure the current efficiency tends to fall sharply and such higher current densities are therefore undesirable. Preferably, the current density is from 0.5 to 4 $A/dm^2$.

During long-term use of the bath there is a tendency for a ruthenium-containing precipitate to form which deleteriously affects the efficiency of the electrolytes. However, it has been discovered that this tendency appears to occur only at anode potentials above a certain critical figure, namely +350mV with respect to a mercury/mercury oxide reference electrode. It is therefore preferable during long term electroplating to employ a current density which corresponds to an anode potential below this figure and to monitor the anode potential during electroplating to ensure that figure is not exceeded.

Agitation of the bath is not generally required as it can result in some decrease in cathode efficiency. However, it should be noted that agitation of the bath does cause an increase in the brightness of the deposit. If brightness is important, some agitation should therefore be effected despite the reduction in cathode efficiency.

Plating from the bath is usually carried out in a single-compartment cell having insoluble anodes, suitably of platinum or platinized titanium. The cathode (substrate) should be of a material not attacked by the bath solution. If an acidic bath is employed the substrate may if necessary be protected, for example, by a flash coating of gold.

The compound $[Ru_2N(NH_3)_8Cl_2]Cl_3$ may be prepared by adding 10g of the compound $(NH_4)_3[Ru_2N(H_2O)_2Cl_8]$ dissolved in a minimum quantity of water dropwise into 800cm$^3$ of boiling concentrated aqueous ammonia. The resulting solution is filtered to remove small quantities of insoluble material and the clear orange-red filtrate is evaporated to small volume and treated with 100cm$^3$ of concentrated hydrochloric acid to yield an orange precipitate. The product is filtered off, washed with water and dried, the yield being 5.2g (60%). The composition of the product can be verified by infrared spectroscopy. If desired, the bromide analogue, $[Ru_2N(NH_3)_8Br_2]Br_3$ may be obtained in a similar manner using $(NH_4)3[Ru_2N(H_2O)_2Br_8]$ and hydrobromic acid.

Some examples will now be given describing the preparation of baths of the invention and their use for the electrodeposition of ruthenium.

EXAMPLE I

A solution was prepared by dissolving 2.6g of $[Ru_2N(NH_3)_8Cl_2]Cl_3$ and 1.4g of potassium dihydrogen phosphate in 180cm$^3$ of distilled water. The pH of the solution was adjusted to 13.0 by the addition of potassium hydroxide solution and made up to a final volume of 200cm$^3$. The bath so formed therefore contained 1g of ruthenium corresponding to a ruthenium concentration of 5g per liter.

Plating tests from this bath were then carried out in a single compartment cell at a constant temperature of 70° C onto a copper disc cathode 25.4mm in diameter and a total surface area of 0.1 dm$^2$. A platinum sheet anode was employed and current was supplied from a constant-current power supply and measured with a conventional moving-coil milliammeter. In addition, the potential of the anode was measured against a mercury/mercury oxide reference electrode using a digital voltmeter.

In a first test a total current of 60mA (cathode current density 0.6 A/dm$^2$) was passed for 20 minutes and a deposit of 10.9mg of ruthenium (0.9 $\mu$m average thickness) was formed, corresponding to a cathode current efficiency of 58% (calculated on the basis of Ru (IV)). The anode potential was typically +370mV with respect to the Hg/HgO reference electrode. Although the ruthenium deposit was good in all respects, a substantial amount of a black precipitate had formed in the electrolyte. The presence of this precipitate demonstrates the disadvantage of employing anode potentials exceeding 350mV.

In a second test, the bath used in the first test was filtered to remove the black precipitate and the current was reduced to 40mA (cathode current density 0.4 A/dm$^2$) and passed for 20 minutes. A good, bright 6.4mg deposit of ruthenium (0.5 $\mu$m average thickness) was formed on the copper cathode, corresponding to a cathode current efficiency of 51%. The maximum anode potential observed with this lower current was +350mV and no signs of precipitate formation could be detected.

A subsequent series of tests with this bath in which the anode potential was never allowed to rise above +350mV gave good deposits at cathode current efficiencies between 40 and 50% and showed no signs of precipitate formation.

EXAMPLE II

A further bath was prepared by dissolving a quantity of the complex $[Ru_2N(NH_3)Cl_2]Cl_3$ in aqueous ammonia to provide a solution containing 17 gl$^{-1}$ of the complex and having a pH of 10. At a temperature of 70° C and a cathode current density of 1.0 A/dm$^2$, bright adherent deposits were formed on 25.4 mm diameter copper disc substrates using insoluble platinum anodes.

EXAMPLE III

Another bath was prepared containing 15 gl$^{-1}$ of the complex $[Ru_2N(NH_3)_8Cl_2]Cl_3$ and 30 gl$^{-1}$ of potassium dihydrogen phosphate in water with the pH adjusted over the range 10 to 14 using potassium hydroxide solution. At a temperature of 70° C and a cathode current density of 2 A/dm$^2$, bright, adherent deposits were obtained up to 1 $\mu$m thick in all tests over the above pH range. In these tests, the preferred pH was 14 in order to obtain an optimum plating efficiency, cathode current efficiencies being in excess of 25% at this pH.

EXAMPLE IV

Finally, tests with a bath containing 16 gl$^{-1}$ of the complex $[Ru_2N(NH_3)_8Cl_2]Cl_3$ were conducted over a pH range of 7 to 14, adjusted by means of potassium hydroxide. In all tests the temperature of the bath was 70° C and the cathode current density was from 2 to 3 A/dm$^2$. Bright, adherent, ruthenium deposits having a depth of at least 1 $\mu$m were obtained in all cases. In these tests, the preferred pH was 13 at which value the cathode current efficiencies were typically 10 to 12%.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and the appended claims.

I claim:

1. A process in which ruthenium is electrodeposited from a bath comprising an aqueous solution of a ruthenium compound in which the ruthenium is present in a cationic complex of the formula $$[Ru_2N(NH_3)_8X_2]^{3+}$$

where X is a chlorine, bromine or iodine.

2. A process according to claim 1 in which the ruthenium compound is $$[Ru_2N(NH_3)_8X_2]X_3$$

where each X is chlorine, bromine or iodine.

3. A process according to claim 2 in which the ruthenium compound is $$[Ru_2N(NH_3)_8Cl_2]Cl_3.$$

4. A process according to claim 1 in which the solution is alkaline.

5. A process according to claim 4 in which the pH of the solution is from 10 to 14.

6. A process according to claim 1 in which the bath also contains a phosphoric acid/phosphate mixture formed by the addition of from 5 to 50 gl$^{-1}$ of potassium dihydrogen phosphate.

7. A process according to claim 1 in which the solution contains from 0.5 to 20 $gl^{-1}$ of ruthenium.

8. A process according to claim 1 in which the bath temperature is from 60° to 80° C.

9. A process according to claim 1 in which a cathode current density of up to 5 $A/dm^2$ is employed.

10. A process according to claim 9 in which a cathode current density of from 0.5 to 4 $A/dm^2$ is employed.

11. A process according to claim 1 in which the anode potential with respect to a mercury/mercury oxide reference electrode does not exceed +350 mV.

12. A process according to claim 1 in which the pH of the solution is from 7 to 14.

13. A bath for the electrodeposition of ruthenium comprising an aqueous solution of a ruthenium compound in which the ruthenium is present in a cationic complex of the formula $$[Ru_2N(NH_3)_8X_2]^{3+}$$

where X is chlorine, bromine or iodine.

14. A bath according to claim 13 in which the ruthenium compound is $$[Ru_2N(NH_3)_8X_2]X_3$$

where each X is chlorine, bromine or iodine.

15. A bath according to claim 13 in which the ruthenium compound is $$[Ru_2N(NH_3)_8Cl_2]Cl_3$$

16. A bath according to claim 13 containing from 0.5 to 20 $gl^{-1}$ of ruthenium.

17. A bath according to claim 16 containing less than 10 $gl^{-1}$ of ruthenium.

18. A bath according to claim 13 which is alkaline.

19. A bath according to claim 18 in which the pH of the solution is from 10 to 12.

20. A bath according to claim 13 which also contains a phosphoric acid/phosphate mixture formed by the addition of from 5 to 50 $gl^{-1}$ of potassium dihydrogen phosphate.

21. A bath according to claim 13 in which the pH of the solution is from 7 to 14.

* * * * *